US007913634B2

(12) United States Patent
Sakano

(10) Patent No.: US 7,913,634 B2
(45) Date of Patent: Mar. 29, 2011

(54) SEWING MACHINE

(75) Inventor: Masahiro Sakano, Chofu (JP)

(73) Assignee: Juki Corporation, Tokyo (JP)

( * ) Notice: Subject to any disclaimer, the term of this patent is extended or adjusted under 35 U.S.C. 154(b) by 410 days.

(21) Appl. No.: 12/202,519

(22) Filed: Sep. 2, 2008

(65) Prior Publication Data

US 2009/0056608 A1 Mar. 5, 2009

(30) Foreign Application Priority Data

Sep. 3, 2007 (JP) ..... 2007-227821

(51) Int. Cl.
*D05B 61/00* (2006.01)
*D05B 1/08* (2006.01)

(52) U.S. Cl. ..... 112/275; 112/163; 112/302

(58) Field of Classification Search ..... 112/275, 112/163, 197–201, 302, 187, 165
See application file for complete search history.

(56) References Cited

U.S. PATENT DOCUMENTS 5,383,414 A * 1/1995 Winter et al. ..... 112/162
5,653,187 A * 8/1997 Kawamoto et al. ..... 112/320
5,901,655 A * 5/1999 Sadasue ..... 112/162
6,973,887 B2 * 12/2005 Rattay ..... 112/197
7,107,919 B2 * 9/2006 Hasegawa ..... 112/100

FOREIGN PATENT DOCUMENTS

JP 02001104673 A * 4/2001
JP 02003169982 A * 6/2003
JP 3693323 7/2005
JP 02008259571 A * 10/2008

* cited by examiner

*Primary Examiner* — Ismael Izaguirre
(74) *Attorney, Agent, or Firm* — Drinker Biddle & Reath LLP

(57) ABSTRACT

A sewing machine is provided. The sewing machine includes a top covering shaft mechanism, a spreader mechanism detachably attached to the top covering shaft mechanism from below and operable to catch a covering thread and to interlace the covering thread with a needle thread inserted into a needle to form covering stitches, and an operating member having a hook portion and rotatably attached to either one of the top covering shaft mechanism and the spreader mechanism. The other of the top covering shaft mechanism and the spreader mechanism has a protrusion with which the hook portion is engageable. The operating member is rotatable between a position at which the hook portion engages with the protrusion to lock the spreader mechanism with respect to the top covering shaft mechanism and another position at which the spreader mechanism is detachable from the top covering shaft mechanism.

9 Claims, 7 Drawing Sheets

SEWING MACHINE

CROSS-REFERENCE TO RELATED APPLICATION

The present application claims priority from Japanese Patent Application No. 2007-227821 filed on Sep. 3, 2007, the entire content of which is incorporated herein by reference.

FIELD OF INVENTION

The present invention relates to a sewing machine which is operable to form covering stitches.

DESCRIPTION OF RELATED ART

Related art sewing machines have three needles, through which needle threads are inserted respectively and which are arranged in a direction intersecting a cloth feeding direction, and a spreader with which a covering thread is controlled. More specifically, the spreader carries out, synchronously with a vertical motion of the three needles, a circular motion above a workpiece from a side of the needles toward a front of the needles to interlace the covering thread with the three needle threads. Synchronously with the interlacing operation of the spreader, a looper is rotated to interlace a looper thread with the needle threads below a throat plate on which the workpiece is placed, whereby a covering stitch is formed on the workpiece (see, e.g., JP 3693323 B2).

In a related art example, the spreader is attached to a top covering shaft, which is attached to a jaw portion of a sewing machine body, with a screw. In another related art example, the spreader is fitted into an inserting hole of a plastic lever, and an elastic deformation of a click portion of the lever is utilized to hold and to remove the spreader.

However, in a case in which the spreader is attached to the top covering shaft with the screw, it is necessary to fasten or to loosen the screw with a driver or a wrench when attaching or detaching the spreader, which is a time-consuming work for a user. In a case in which the spreader is attached to the lever by utilizing the elasticity of the plastic lever, on the other hand, there has been a problem that the elasticity of the lever deteriorates while being used, resulting in an unfirm holding of the spreader.

SUMMARY OF INVENTION

It is an object of the present invention to provide a sewing machine in which a spreader can be easily attached or detached.

According to an aspect of the present invention, a sewing machine is provided. The sewing machine includes a top covering shaft mechanism, a spreader mechanism detachably attached to the top covering shaft mechanism from below and operable to catch a covering thread and to interlace the covering thread with a needle thread inserted into a needle to form covering stitches, and an operating member having a hook portion and rotatably attached to either one of the top covering shaft mechanism and the spreader mechanism. The other of the top covering shaft mechanism and the spreader mechanism has a protrusion with which the hook portion is engageable. The operating member is rotatable between a position at which the hook portion engages with the protrusion to lock the spreader mechanism with respect to the top covering shaft mechanism and another position at which the spreader mechanism is detachable from the top covering shaft mechanism.

Other aspects and advantages of the invention will be apparent from the following description, the drawings and the claims.

DETAILED DESCRIPTION

Hereinafter, an exemplary embodiment of the invention will be explained with reference to the drawings. The following exemplary embodiment does not limit the scope of the invention.

Figure 1:
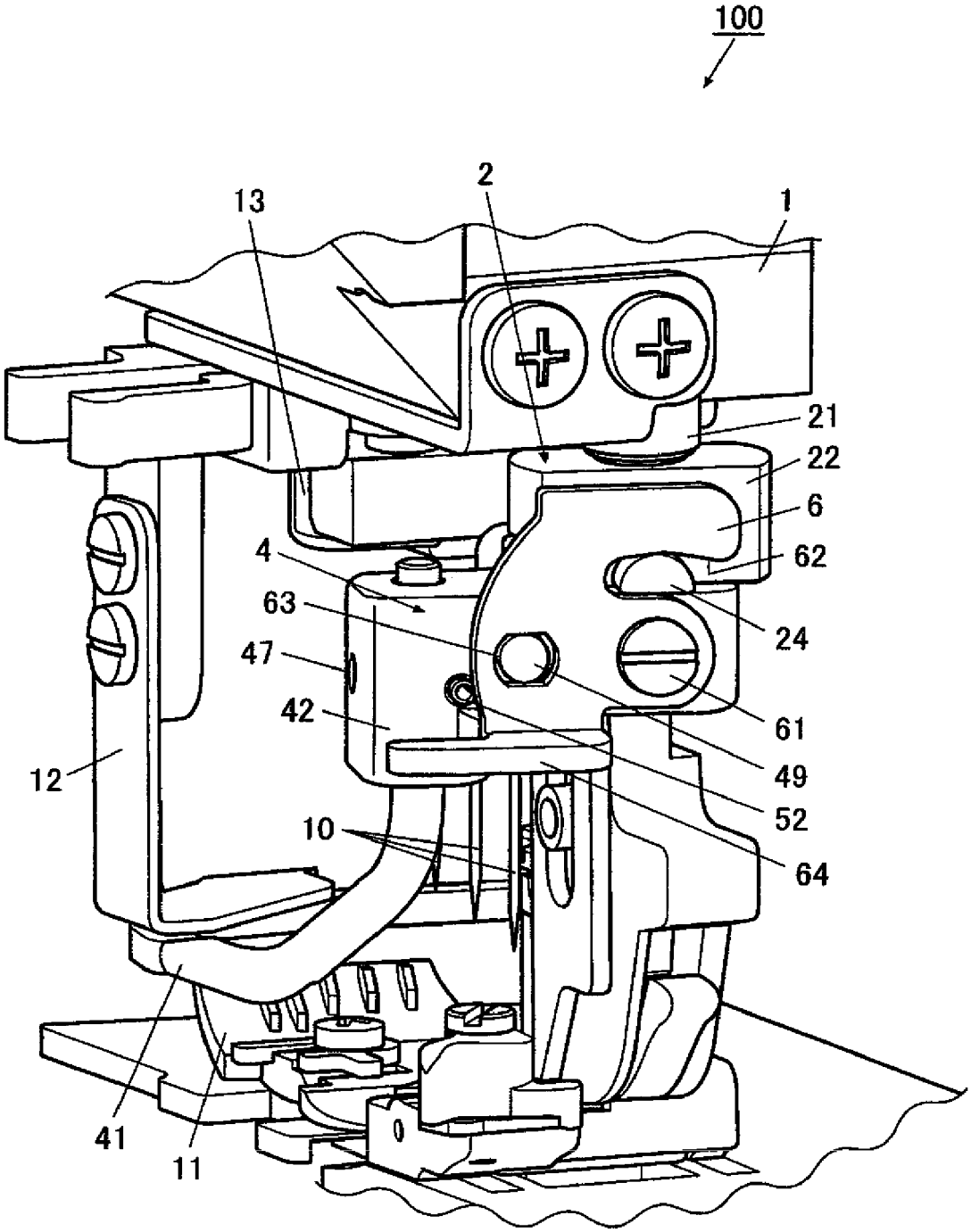
FIG. 1 is a perspective view illustrating a configuration around a jaw portion of a sewing machine according to an exemplary embodiment of the present invention.

As shown in FIG. 1, a sewing machine 100 includes a top covering shaft mechanism 2 disposed near a jaw portion of a sewing machine body 1, a spreader mechanism 4 detachably attached to the top covering shaft mechanism 2 from below, an operating member 6 attached to the spreader mechanism 4, a plurality of needles 10 respectively having an eye through which a corresponding needle thread is inserted and are vertically moved by a sewing machine motor to insert the needle threads into a workpiece, a presser 11 disposed below the needles 10 to press the workpiece against a throat plate, and thread guides 12, 13 which guide a covering thread to the spreader mechanism 4. The operating member 6 is rotatable between a position at which the spreader mechanism 4 is locked with respect to the top covering shaft mechanism 2 and another position at which the spreader mechanism 4 is detachable from the top covering shaft mechanism 2.

Top Covering Shaft Mechanism

As shown in FIGS. 1 to 5, the top covering shaft mechanism 2 includes a top covering shaft 21 downwardly extending from a lower portion of the jaw portion of the sewing machine body 1, and an engaging base 22 through which the top covering shaft 21 is inserted. The top covering shaft 21 has a cylindrical shape. A lower end portion of the top covering shaft 21 is formed as a tapered portion 23 which is inclined with respect to an axial direction of the top covering shaft 21 such that a section area is gradually reduced toward a lower end thereof. The top covering shaft 21 is inserted through the engaging base 22 from above such that the tapered portion 23 downwardly projects from a lower end face of the engaging base 22 and a cylindrical portion of the top covering shaft 21 is surrounded by an inner wall of the engaging base 22.

The engaging base 22 has a protrusion 24 which protrudes outward from a lower end portion of a side face of the engaging base 22. The protrusion 24 has a semicircular shape when seen from a front, and an arcuate portion thereof is on an upper side of the protrusion 24. When attaching the spreader mechanism 4 to the top covering shaft mechanism 2, the operating member 6 engages with the protrusion 24 to prevent the spreader mechanism 4 from dropping off.

Figure 4:
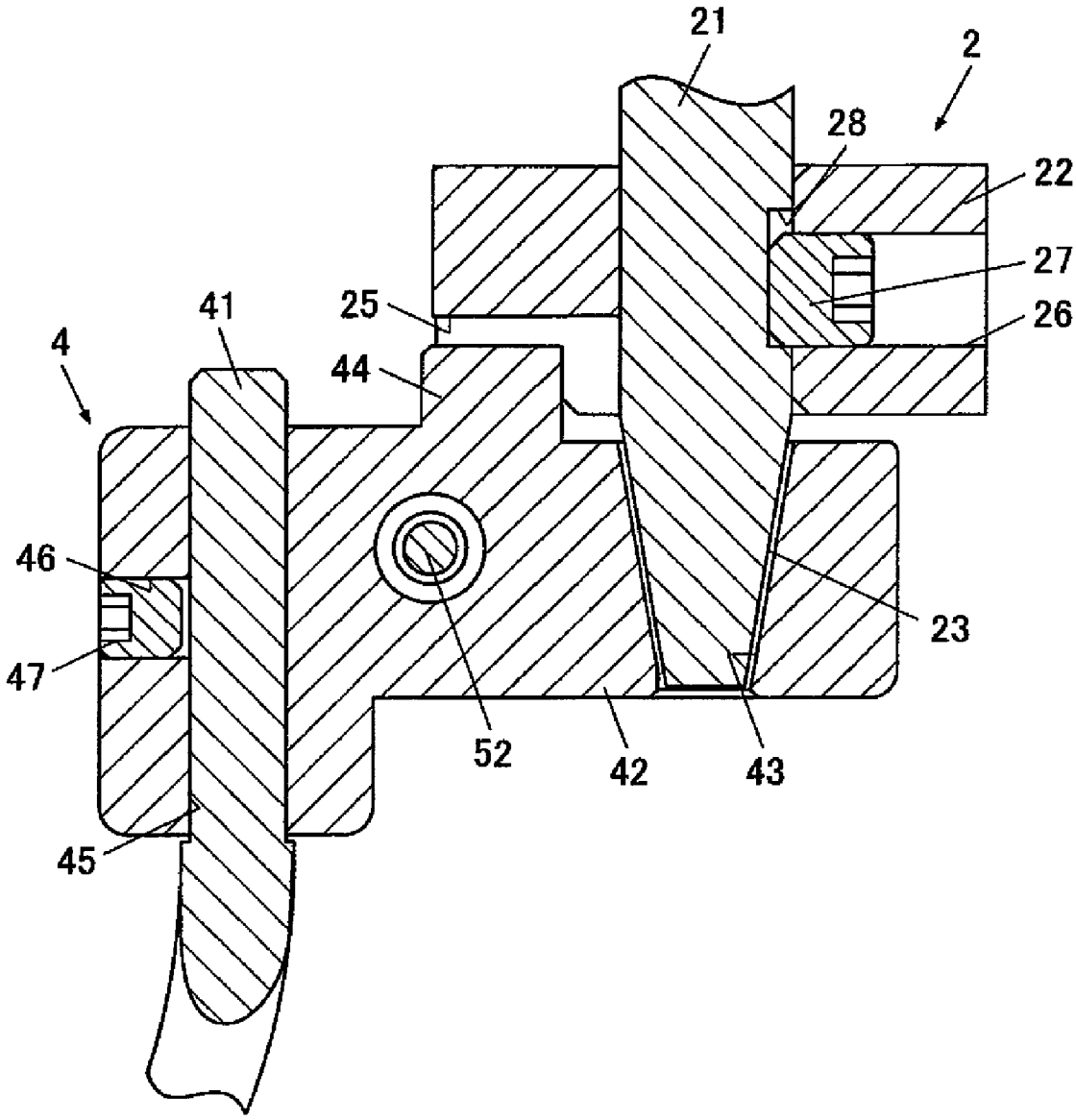
FIG. 4 is a vertical sectional view taken along the line IV-IV of FIG. 2.

The lower end face of the engaging base 22 is formed with a concave portion 25 which is downwardly opened. A side face of the engaging base 22 is formed with a screw hole 26 into which a first setscrew 27 is screwed to fix the engaging base 22 to the top covering shaft 21. More specifically, as shown in FIG. 4, a fixing groove 28 is formed on an outer circumferential surface of the top covering shaft 21 to extend in the axial direction thereof, and a tip end of the first setscrew 27 is pressed against the fixing groove 28 to fix the engaging base 22 to the top covering shaft 21. Accordingly, it is possible to adjust a position of the engaging base 22 with respect to the axial direction of the top covering shaft 21 depending on a position at which the first setscrew 27 is pressed against the fixing groove 28.

Spreader Mechanism

As shown in FIGS. 1, 2, 4 and 5, the spreader mechanism 4 includes a spreader 41 which catches the covering thread to interlace the covering thread with the needle threads, and a spreader support base 42 supporting the spreader 41. The spreader 41 is a rod-like member, and is bent at a plurality of portions thereof. The spreader 41 has a pawl portion at a tip end portion thereof to catch the covering thread. The spreader 41 is rotatably inserted through the spreader support base 42 so as to be slidable in the vertical direction so that and a rotational position and a height of the spreader 41 can be adjusted.

The spreader support base 42 has a receiving portion 43 into which the top covering shaft 21 is fitted such that the tapered portion 23 is accommodated inside the receiving portion 43 so as to contact the receiving portion 43.

An upper end face of the spreader support base 42 is formed with a convex portion 44 which is fittable in the concave portion 25 of the engaging base 22. The convex portion 44 horizontally extends along the upper end face of the spreader support base 42.

The spreader support base 42 is formed with a through hole 45 penetrating from the upper end face to a lower end face thereof. The spreader 41 is rotatably inserted into the through hole 45 so as to be slidable in the vertical direction. A screw hole 46 is formed on a side face of the spreader support base 42 toward the through hole 45. A second setscrew 47 is screwed into the screw hole 46, and a tip end of the second setscrew 47 is pressed against an outer circumferential surface of the spreader 41 to fix the spreader 41 to the spreader support base 42. Accordingly, it is possible to adjust a position of the spreader 41 with respect to the spreader support base 42 depending on a position at which the second setscrew 47 is pressed against the outer peripheral surface of the spreader 41.

The operating member 6 is rotatably attached to a front face of the spreader support base 42 with a setscrew 61. The operating member 6 is rotatable between the position at which the spreader mechanism 4 is locked with respect to the top covering shaft mechanism 2 and the other position at which the spreader mechanism 4 is detachable from the top covering shaft mechanism 2.

The spreader support base 42 is formed with another through hole 48 penetrating from the front face to a rear face thereof. A locking member 49 is provided in the through hole 48. The locking member 49 has a tip portion, and is movable between a position at which the tip portion projects from the front face of the spreader support base 42 to fit in the operating portion 6 and another position at which the tip portion is disengaged from the operating member 6. The locking member 49 is constantly biased by a spring 50 (an elastic member) in a direction in which the tip portion projects from the spreader support base 42 toward the operating member 6. A rear end portion of the locking member 49 is attached to the rear face of the spreader support base 42 via an E-ring 51 so that it is prevented from slipping out of the through hole 48.

A stopper 52 is arranged on the front face of the spreader support base 42 to regulate the rotation of the operating member 6. More specifically, the stopper 52 is arranged such that the stopper 52 contacts the operating member 6 to block the rotation of the operating member 6 only when the operating member 6 is rotated to a position at which the operating member 6 and the protrusion 24 are disengaged from each other so that the spreader mechanism 4 becomes detachable from the top covering shaft mechanism 2.

Operating Member

Figure 2:
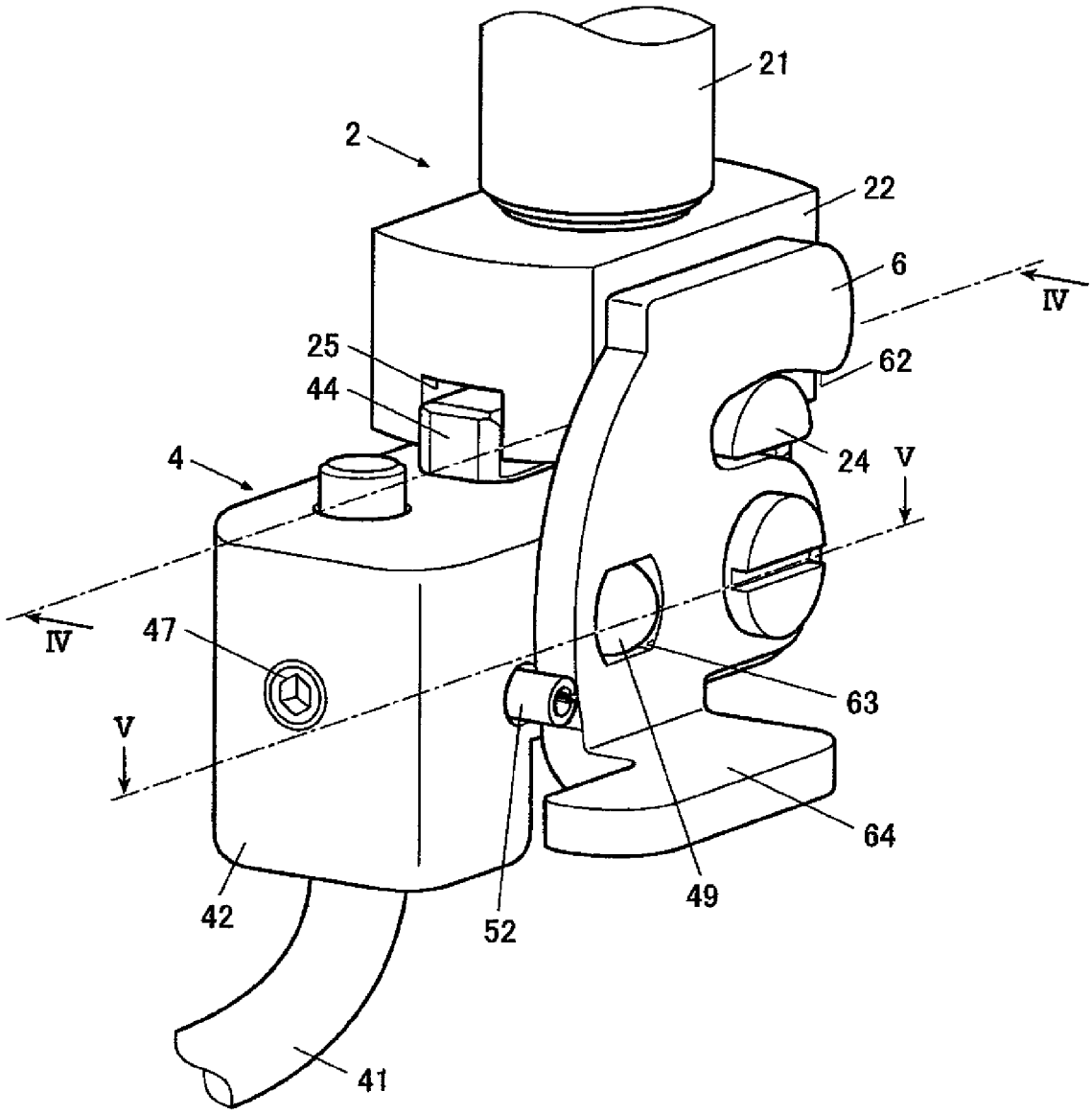
FIG. 2 is a perspective view of a top covering shaft mechanism and a spreader mechanism of the sewing machine.
Figure 3:
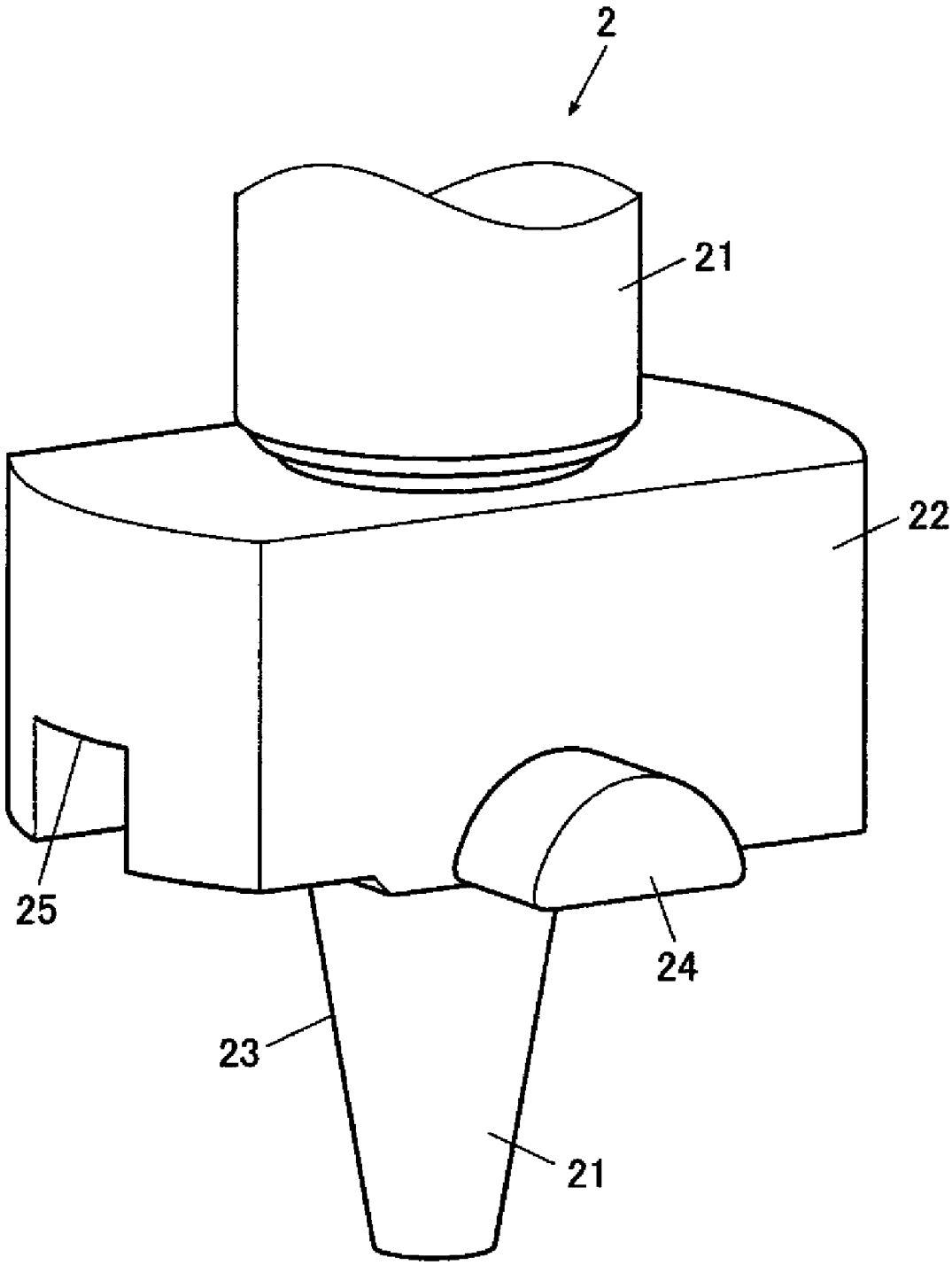
FIG. 3 is a perspective view of the top covering shaft mechanism.
Figure 5:
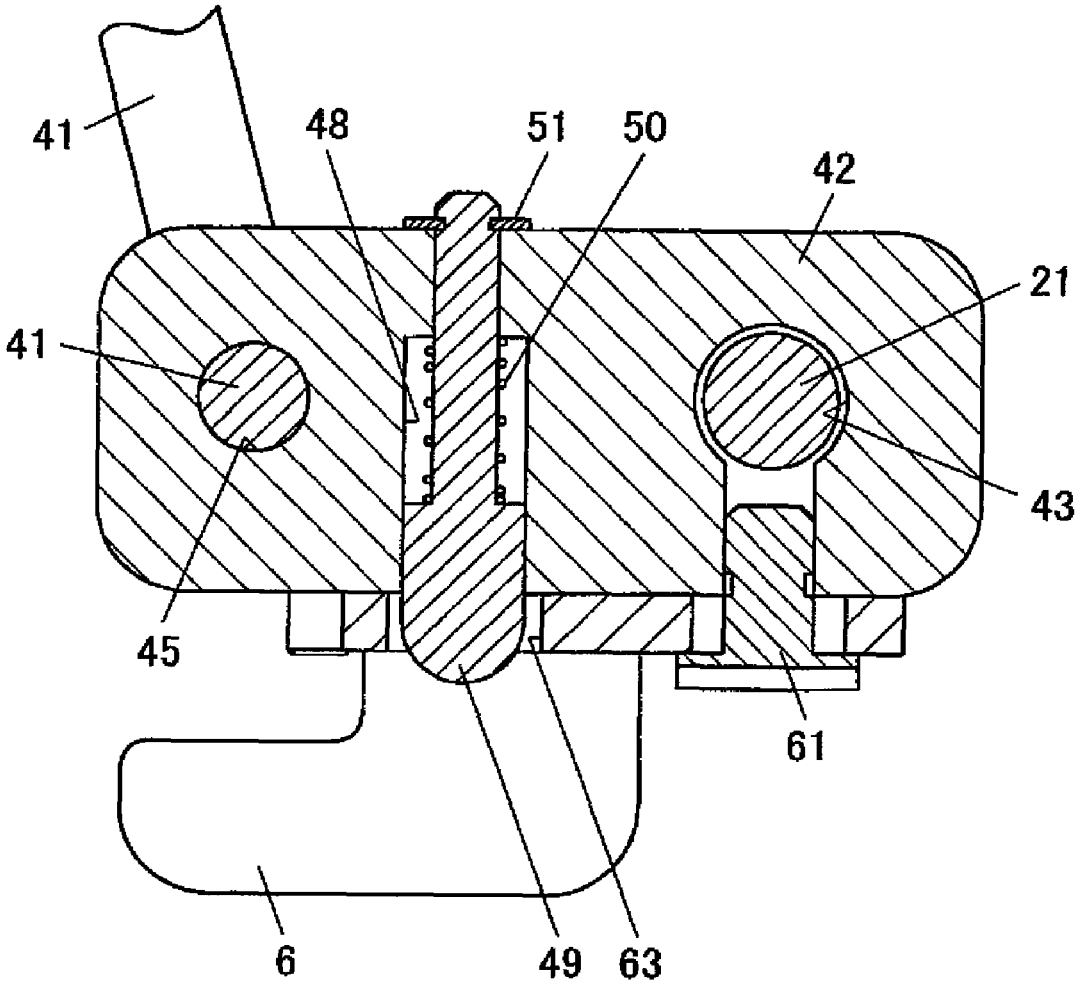
FIG. 5 is a sectional view taken along the line V-V of FIG. 2.

As shown in FIGS. 1, 2 and 5, the operating member 6 is rotatably attached to the front face of the spreader support base 42 with the setscrew 61. The operating member 6 engages with the protrusion 24 to prevent the spreader mechanism 4 from dropping off from the top covering shaft mechanism 2. When the operating member 6 is disengaged from the protrusion 24, the spreader mechanism 4 becomes detachable from the top covering shaft mechanism 2.

More specifically, the operating member 6 has a hook portion 62 which is engageable with the protrusion 24 to lock the spreader mechanism 4 to the top covering shaft mechanism 2. The hook portion 62 has such a shape as to be hung on an upper side of the protrusion 24 when it is engaged with the protrusion 24. That is, the hook portion 63 of the operating member 6 restricts a downward movement of the spreader mechanism 4 to prevent the spreader mechanism 4 from dropping off the top covering shaft mechanism 2.

The operating member 6 is formed with a locking hole 63. When the hook portion 62 is engaged with the protrusion 24, the tip portion of the locking member 49 projects out from the spreader support base 42 by the elastic force of the spring 50 and is fitted in the locking hole 62 to securely lock the spreader mechanism 4 to the top covering shaft mechanism 2. In a state in which the locking member 49 is not fitted in the locking hole 63, accordingly, the operating member 6 is rotatable until it hits the stopper 52.

The operating member 6 has a tab 64 adapted to be operated by a user. More specifically, the user holds the tab 64 when rotating the operating member 6.

Attaching and Detaching of Spreader Mechanism

Figure 6:
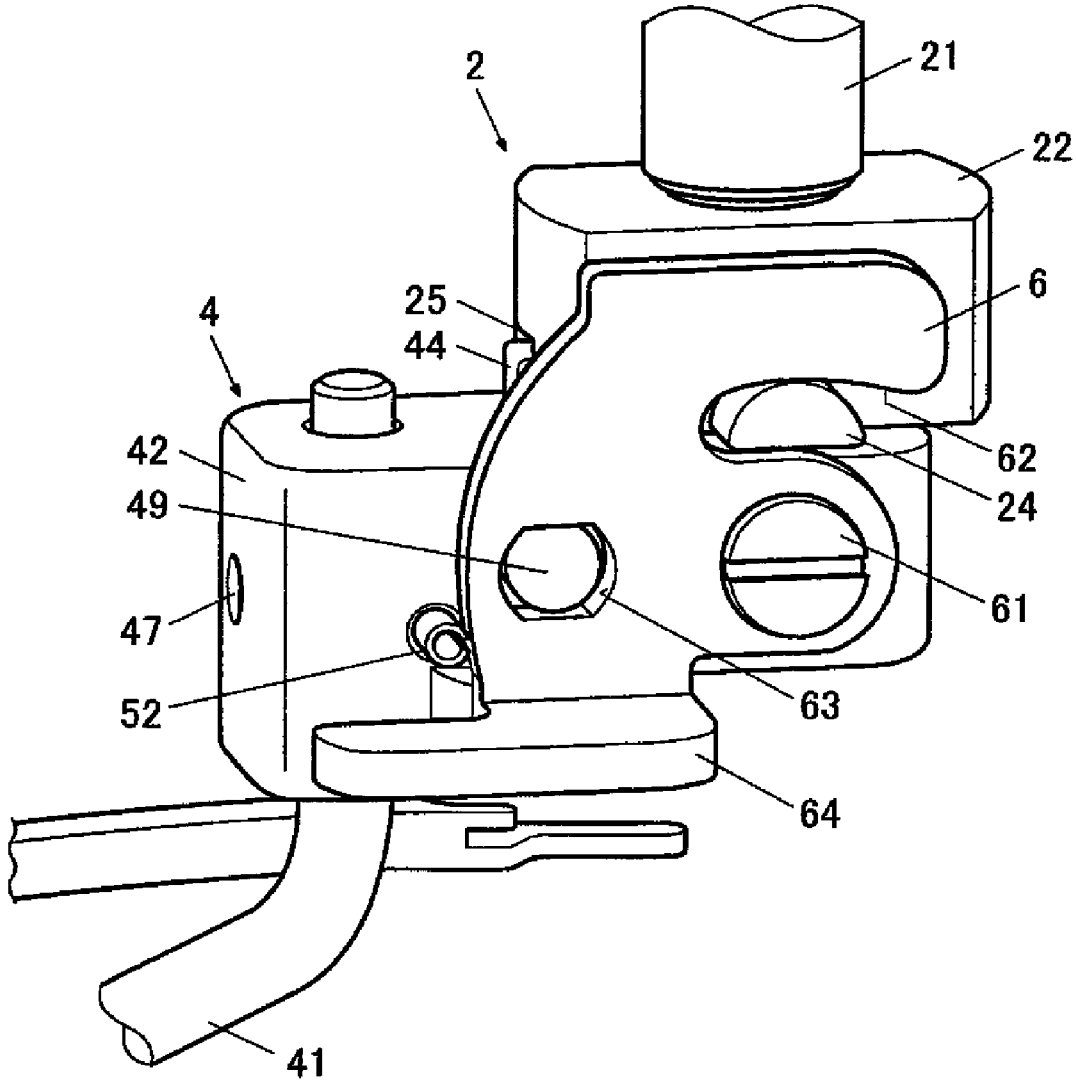
FIG. 6 is a perspective view illustrating a state in which the spreader mechanism is attached to the top covering shaft mechanism.

When attaching the spreader mechanism 4 to the top covering shaft mechanism 2, the spreader mechanism 4 is attached to the top covering shaft mechanism 2 from below. At this time, the top covering shaft 21 is fitted in the receiving portion 43 of the spreader support base 42, and the convex portion 44 of the spreader support base 42 is fitted in the concave portion 25 of the engaging base 22. Then, the operating member 6 is rotated clockwise around the setscrew 61 by operating the tab 64 to prevent the spreader mechanism 4 from dropping. More specifically, as shown in FIG. 6, by rotating the operating member 6, the hook portion 62 of the operating member 6 engages with the protrusion 24, and the locking member 49 is fitted in the locking hole 63 of the operating member 6, so that the spreader mechanism 4 is fixed to the top covering shaft mechanism 2. Whether the spreader mechanism 4 is completely attached to the top covering shaft mechanism 2, i.e., whether the operating member is rotated until the hook portion 62 engages with the protrusion 24, can be confirmed by a visually checking the locking member 49 fitted in the locking hole 63.

When the spreader mechanism 4 is completely attached to the top covering shaft mechanism 2, the engagement of the top covering shaft 21 and the receiving portion 43 restricts the spreader mechanism 4 from moving in a plane orthogonal to the axial direction of the top covering shaft 21 and in an upward direction along the axial direction of the top covering shaft 2. Moreover, the engagement of the protrusion 24 and the hook portion 62*a* restricts the spreader mechanism 4 from moving in a downward direction along in the axial direction of the top covering shaft 21, and the engagement of the concave portion 25 and the convex portion 44 restricts the spreader mechanism 4 from rotating. Furthermore, the engagement of the locking member 49 and the locking hole 63 restricts the operating member 6 from rotating.

Figure 7:
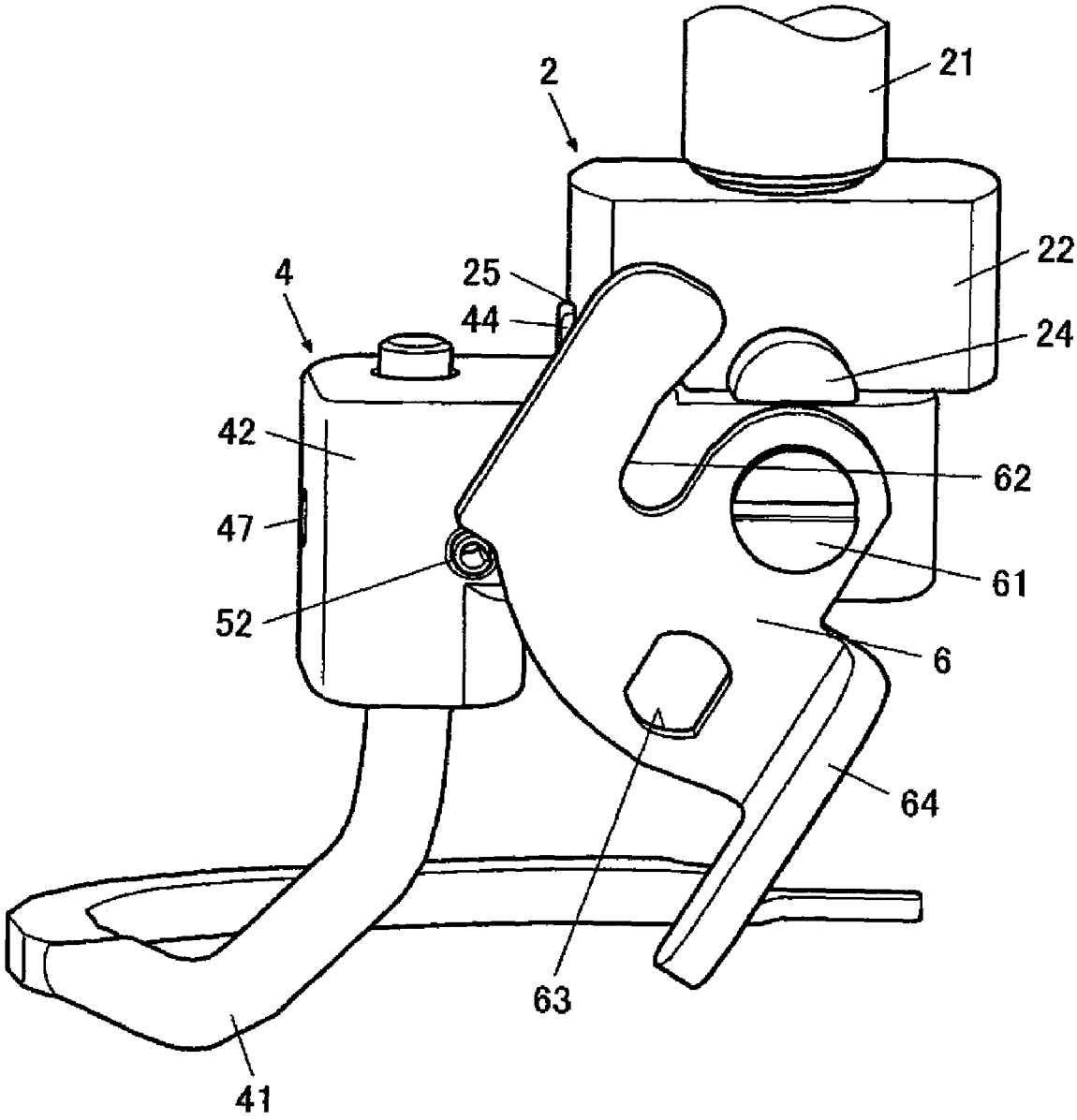
FIG. 7 is a perspective view illustrating a state in which the spreader mechanism is detachable from the top covering shaft mechanism.

When detaching the spreader mechanism 4 from the top covering shaft mechanism 2, the locking member 49 is inwardly pressed against the elastic force of the spring 50 to allow the rotation of the operating member 6. In this state, the operating member 6 is rotated counterclockwise around the setscrew 61 be operating the tab 64. By the rotation of the operating member 6, the hook portion 62 is disengaged from the protrusion 24 so that the spreader mechanism 4 becomes detachable from the top covering shaft mechanism 2. Since the locking member 49 cannot engage with the operating member 6 at portions other than the locking hole 63, the locking member 49 does not interrupt the rotation of the operating member 6 during the rotation. Eventually, as shown in FIG. 7, the operating member 6 hits the stopper 52, whereby the rotation of the operating member 6 is blocked. At this time, the hook portion 62 is completely disengaged from the protrusion 24 so that the spreader mechanism 4 can be detached from the top covering shaft mechanism 2.

According to the sewing machine 100 of the exemplary embodiment described above, the engagement of the hook portion 62 and the protrusion 24 prevents the spreader mechanism 4 from falling from the top covering shaft mechanism 2. That is, unlike the related art, the spreader mechanism 4 is not held by an elastic fitting structure. Therefore, there is no drawback that the elasticity of a plastic member deteriorates with the usage which causes an unstable holding of the spreader.

Further, a user can attach or detach the spreader mechanism 4 with respect to the top covering shaft mechanism 2 only by rotating the operating member 6 between two positions. Thus, as compared with the screwing operation or the like in the related art, it is possible to attach or to detach the spreader 41 more easily and smoothly.

Further, the tapered portion 23 of the top covering shaft 21 fits into the receiving portion 43 so as to contact with each other. Therefore, it is possible to accurately position the spreader 41 with respect to the top covering shaft 21 and to prevent a play in the coupling portion of the spreader mechanism 4 and the top covering shaft mechanism 2.

Further, the convex portion 44 fits into the concave portion 25. Thus, it is possible to easily position the spreader mechanism 4 with respect to the top covering shaft mechanism 2 in a rotational direction around the top covering shaft 21. Furthermore, the engagement of the convex portion 44 and the concave portion 25 prevents the spreader mechanism 4 from rotating with respect to the top covering shaft mechanism 2. Therefore, it is possible to ensure a torque transmission from the top covering shaft 21 to the spreader mechanism 4.

Further, when attaching the spreader mechanism 4 to the top covering shaft mechanism 2, the locking member 49 enters the locking hole 63 to prevent the rotation of the operating member 6, thereby locking the spreader mechanism 4 to the top covering shaft mechanism 2. On the other band, when rotating the operating member 6 to detach the spreader mechanism 4 from the top covering shaft mechanism 2, the locking member 49 is pushed in against the elastic force of the spring 50 to disengage the locking member 49 from the operating member 6, thereby unlocking t the spreader mechanism 4 from the top covering shaft mechanism 2. Accordingly, it is possible to easily release the spreader mechanism 4 from the top covering shaft mechanism 2 by a simple operation of pushing the locking member 49.

The position of the engaging base 22 with respect to the top covering shaft 21 is adjustable by loosing the first setscrew 27. The engaging base 22 is fixed to the top covering shaft 21 with the first setscrew 27 such that, when the locking member 49 is fitted in the locking hole 63, the hook portion 62 of the operating member 6 engages with the protrusion 24 without a clearance there between. On the other hand, the position of the spreader 41 with respect to the spreader support base 42 is adjustable with the second setscrew 47. Therefore, the relative position of the spreader 41 with respect to the needles can be easily adjusted independently from other adjustments.

Further, whether the spreader mechanism 4 is completely attached to the top covering shaft mechanism 2 can be confirmed by visually observing the locking member 49 through the locking hole 63. Therefore, it is possible to facilitate the attaching work.

Further, in a state in which the spreader mechanism 4 is detached, components related to the spreader 41 and disposed around the jaw portion of the sewing machine body 1 are only the top covering shaft 21 and the engaging base 22. Therefore, when carrying out a sewing work without the spreader 41, it is possible to provide a large space around the jaw portion of the sewing machine body 1, thereby enhancing working efficiency, e.g., allowing an easy handling of a cloth.

Modifications

The present invention is not limited to the exemplary embodiment described above. For example, the operating member 6 may be attached to the top covering shaft mechanism 2 and the protrusion 24 may be formed on the spreader mechanism 4.

Further, the concave portion 25 may be formed on the spreader support base 42 and the convex portion 44 may be formed on the engaging base 22.

Further, the locking member 49 may be configured to project from the engaging base 22 and the locking hole 63 may be formed at another portion of the operating member 6 corresponding to the locking member 49.

While description has been made in connection with an exemplary embodiment of the present invention and some modifications thereof, those skilled in the art will understand that various changes and other modification may be made therein without departing from the present invention. It is aimed, therefore, to cover in the appended claims all such changes and modifications falling within the true spirit and scope of the present invention.

What is claimed is:

1. A sewing machine comprising:

a top covering shaft mechanism attached to a sewing machine body;

a spreader mechanism detachably attached to the top covering shaft mechanism from below, wherein the spreader mechanism is operable to catch a covering thread and to interlace the covering thread with a thread inserted into a needle to form covering stitches; and an operating member comprising a hook portion and rotatably attached to either one of the top covering shaft mechanism and the spreader mechanism, wherein the other of the top covering shaft mechanism and the spreader mechanism comprises a protrusion with which the hook portion is engageable, and the operating member is rotatable between a position at which the hook portion engages with the protrusion to lock the spreader mechanism with respect to the top covering shaft mechanism and another position at which the spreader mechanism is detachable from the top covering shaft mechanism.

2. The sewing machine according to claim 1, wherein the top covering shaft mechanism comprises a top covering shaft having a tapered portion on a side face thereof and downwardly extending to be inserted into the spreader mechanism, and the spreader mechanism comprises a receiving portion into which the top covering shaft is fittable such that the top covering shaft contacts the receiving portion.

3. The sewing machine according to claim 1, wherein either one of the top covering shaft mechanism and the spreader mechanism comprises a horizontally extending convex portion, and the other of the top covering shaft mechanism and the spreader mechanism comprises a concave portion inside which the convex portion is fittable.

4. The sewing machine according to claim 1, further comprising a locking member biased toward the operating member by an elastic force of an elastic member, wherein the operating member is formed with a locking hole into which the locking member enters when the operating member is at the position at which the spreader mechanism is locked with respect to the top covering shaft mechanism.

5. The sewing machine according to claim 2, wherein the top covering shaft mechanism further comprises an engaging base through which the top covering shaft is inserted and on which the protrusion is formed, the spreader mechanism further comprises a spreader and a spreader support base supporting the spreader and on which the receiving portion is formed, the engaging base is slidable in a vertical direction with respect to the top covering shaft, and is fixable to the top covering shaft with a first setscrew, and the spreader is inserted into the spreader support base so as to be slidable in the vertical direction, and is fixable to the spreader support base with a second setscrew.

6. The sewing machine according to claim 1, wherein the operating member further comprises a tab adapted to be operated by a user.

7. A sewing machine comprising:

a top covering shaft mechanism comprising:

an engaging base comprising a protrusion; and a top covering shaft inserted through the engaging base and comprising a tapered portion which downwardly extends below the engaging case;

a spreader mechanism comprising:

a spreader support base comprising a receiving portion into which the tapered portion of the top covering shaft is fittable from above; and a spreader inserted into the spreader support base and operable to catch a covering thread and to interlace the covering thread with a needle thread inserted into a needle to form covering stitches;

an operating member rotatably attached to the spreader support base and formed with a locking hole, the operating member comprising:

a hook portion engageable with the protrusion; and a tab adapted to be operated by a user; and a locking member biased toward the operating member by an elastic force of an elastic member, wherein the operating member is rotatable between a position at which the hook portion engages with the protrusion and the locking member enters into the locking hole to lock the spreader mechanism with respect to the top covering shaft mechanism and another position at which the spreader mechanism is detachable from the top covering shaft mechanism.

8. The sewing machine according to claim 7, wherein either one of the engaging base and the spreader support base further comprises a horizontally extending convex portion, and the other of the engaging base and the spreader support base further comprises a concave portion inside which the convex portion is fittable.

9. The sewing machine according to claim 7, wherein the engaging base is slidable in a vertical direction with respect to the top covering shaft and is fixable to the top covering shaft with a first setscrew, and the spreader is slidable in the vertical direction with respect to the spreader support base and is fixable to the spreader support base with a second setscrew.

* * * * *